US006589096B1

(12) United States Patent
Doane, Jr. et al.

(10) Patent No.: US 6,589,096 B1
(45) Date of Patent: Jul. 8, 2003

(54) APPARATUS AND METHOD FOR CREATING AND DESTROYING A SOLID EXTERIOR/ LIQUID INTERIOR TOY

(75) Inventors: Linwood E. Doane, Jr., Johnston, RI (US); Brian Merten, Exeter, RI (US); Fred Daniel Eddins, Mapleville, RI (US); Lev Tsimberg, Pawtucket, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 10/045,334

(22) Filed: Nov. 7, 2001

(51) Int. Cl.[7] ..... A63H 3/36
(52) U.S. Cl. ..... 446/385; 446/71; 446/76
(58) Field of Search ..... 446/385, 86, 71, 446/481, 76, 73

(56) References Cited

U.S. PATENT DOCUMENTS

| | | | | |
|---|---|---|---|---|
| 1,626,148 A | * | 4/1927 | Obrist | |
| 3,541,192 A | | 11/1970 | Shapero et al. | |
| 3,616,101 A | | 10/1971 | Satchell et al. | |
| 4,231,181 A | * | 11/1980 | Fabricant | |
| 4,260,574 A | | 4/1981 | Macomson | |
| 4,261,133 A | | 4/1981 | Hanson et al. | |
| 4,280,695 A | | 7/1981 | Stenehjem et al. | |
| 4,618,330 A | * | 10/1986 | Abe | 446/236 |
| 4,738,647 A | * | 4/1988 | Renger et al. | 446/86 |
| 4,908,001 A | | 3/1990 | Kopian | |
| 4,943,237 A | | 7/1990 | Bryan | |
| 4,952,190 A | | 8/1990 | Tarnoff et al. | |
| 5,006,288 A | | 4/1991 | Rhodes, Jr. et al. | |
| 5,026,054 A | | 6/1991 | Osher et al. | |
| 5,083,770 A | | 1/1992 | Holland | |
| 5,171,151 A | | 12/1992 | Barthold | |
| 5,173,228 A | | 12/1992 | Kargarzadeh et al. | |
| 5,238,440 A | * | 8/1993 | Morin | 446/241 |
| 5,306,192 A | * | 4/1994 | Caveza et al. | 446/71 |
| 5,494,472 A | | 2/1996 | Levy et al. | |
| 5,518,436 A | | 5/1996 | Lund et al. | |
| 5,603,176 A | | 2/1997 | Eddins et al. | |
| 5,934,969 A | | 8/1999 | Rehkemper et al. | |
| 5,954,561 A | * | 9/1999 | Cannone | 446/75 |

* cited by examiner

*Primary Examiner*—Derris Banks
*Assistant Examiner*—Ali Abdelwahed
(74) *Attorney, Agent, or Firm*—Marshall, Gerstein & Borun

(57) ABSTRACT

An apparatus and method for creating and destroying toys having a solid exterior and liquid interior are disclosed. The apparatus and method entail the creation of an impression within a supply of modeling compound using a form having a desired shape. The impression formed within the modeling compound is then filled with a curable liquid which cures upon contact with the modeling compound. The modeling compound remains in contact with the curable liquid for a sufficient length of time to cure an exterior skin while leaving the interior in a liquid state. The liquid interior is then drained and refilled with a non-curable liquid so as to provide a toy having life-like features. The kit further provides a crushing mechanism having a movable plunger adapted to physically crush the toy by rupturing the exterior skin and splattering the liquid interior against a dome of the crushing mechanism.

24 Claims, 5 Drawing Sheets

APPARATUS AND METHOD FOR CREATING AND DESTROYING A SOLID EXTERIOR/ LIQUID INTERIOR TOY

FIELD OF THE INVENTION

The invention generally relates to toys and, more particularly, relates to methods and apparatus for forming toys.

BACKGROUND OF THE INVENTION

Children often enjoy toys which have a creative aspect to them. Fun can be derived as much from the process of building or creating the toy as from using the toy once created. The same can be said of toys which have a disassembly or destructive aspect as well. This is particularly so if the toys are messy or somewhat grotesque in nature, such as monsters, insects, or the like.

For example, Levy, et al., U.S. Pat. No. 5,494,472 discloses a toy provided in the form of a dinosaur with a plurality of microcapsules provided on the exterior surface of the dinosaur. Each of the microcapsules is filled with a thick red colored liquid simulating blood. The microcapsules can be crushed to thereby simulate actual bleeding from the dinosaur.

Similarly, Lund, et al., U.S. Pat. No. 5,518,436 discloses a toy figure which is stretchable and deformable by increasing or decreasing the fluid pressure within the toy. The toy is provided in the form of a monster figure and can be deformed into exaggerated shapes of grotesque proportions. The toy can be so deformed upon rotation of a lever attached to the head of the monster.

Another toy destroying apparatus is disclosed in Hanson, et al., U.S. Pat. No. 4,261,133. Hanson discloses a toy car crushing apparatus. Toy vehicles formed from tin foil can be deposited into a housing of the crushing apparatus. Upon rotation of a crank arm, the walls of the housing close in around the tin foil to crush the car in a manner simulating that of an automatic junk yard automobile crusher.

In light of the above, it would be advantageous to provide additional toys to offer children the opportunity to create items of their own making, while additionally enabling the toy to be crushed or otherwise destroyed.

SUMMARY OF THE INVENTION

In accordance with one aspect of the invention, a kit may be provided which comprises a supply of modeling compound, at least one form adapted to deform the supply of modeling compound to create an impression in the shape of the form, a supply of curable liquid, and a supply of non-curable liquid. The supply of curable liquid is adapted to be poured into the impression and be cured into a toy having a shape complementary to the form. The toy includes a solid exterior skin and a liquid center adapted to be drained. The supply of non-curable liquid is adapted to be injected into the toy after the curable liquid is drained from the toy.

In accordance with another aspect of the invention, a method of fabricating a toy is provided which comprises the steps of creating an impression in the modeling compound, filling the impression with a curable liquid, enclosing the curable liquid with additional modeling compound, curing an exterior layer of the curable liquid to create a toy having a shape corresponding to the impression, removing the curable liquid from an interior of the toy, and filling the interior of the toy with a non-curable liquid.

In accordance with another aspect of the invention, a toy crushing device is provided which comprises a housing base, a transparent cover removably mounted to the housing base, and a plunger reciprocatingly mounted through the cover. The plunger includes a handle and a plate with a plate being movable between a crushing position proximate the housing base, and a loading position raised away from the housing base.

In accordance with yet another aspect of the invention, a toy kit is provided which comprises a supply of calcium enriched modeling compound, a plurality of molds adapted to deform the supply of modeling compound to create an impression, a supply of sodium alginate adapted to be poured into the impression and be cured into a toy having a shape complementary to the form, a supply of LAPONITE® colloidal clay adapted to be injected into the toy after the algin is removed, and a crushing device adapted to compress the toy sufficiently to break the exterior skin of the toy and splatter the LAPONITE® colloidal clay outwardly.

These and other features and aspects of the invention will become more apparent from the following detailed description when taken in conjunction with the accompanying drawings.

Figure 1:
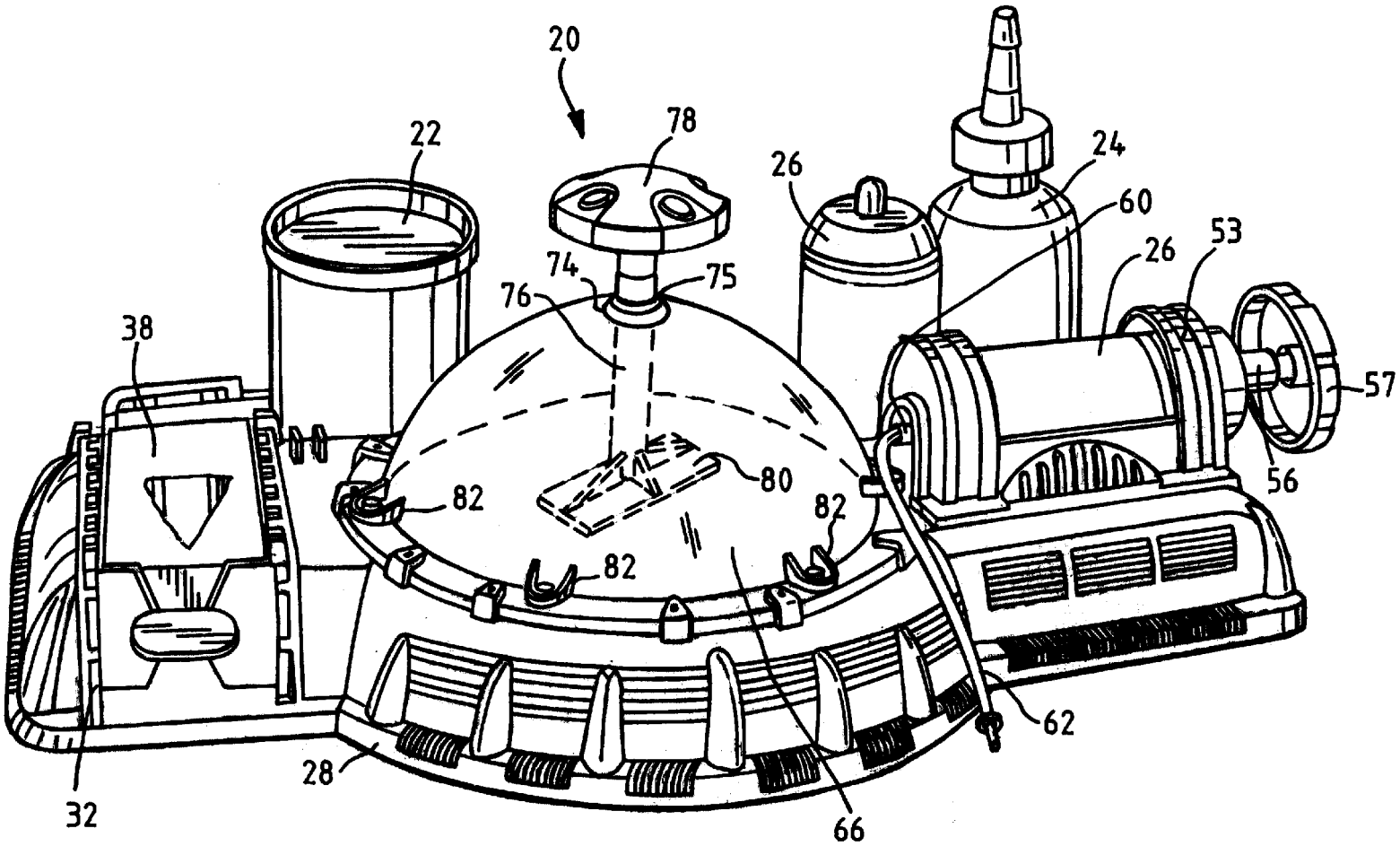
FIG. 1 is a perspective view of a toy kit constructed in accordance with the teachings of the invention.

While the invention is susceptible to various modifications and alternative constructions, certain illustrative embodiments thereof have been shown in the drawings and will be described below in detail. It should be understood, however, that there is no intention to limit the invention to the specific forms disclosed, but on the contrary, the intention is to cover all modifications, alternative constructions, and equivalents falling within the spirit and scope of the invention as defined by the appended claims.

DETAILED DESCRIPTION OF THE PREFERRED EMBODIMENTS

Referring now to the drawings, and with specific reference to FIG. 1, a toy kit constructed in accordance with the teachings of the invention is generally referred to by reference numeral 20. As shown therein, the kit 20 includes a supply of modeling compound 22, a supply of curable liquid 24, a supply of non-curable liquid 26 and a workstation 28. Using such a kit 20, a child can create, as well as destroy, toys 30.

In a preferred embodiment, the modeling compound may be provided in the form of a calcium enriched modeling compound such as, but not limited to, that marketed by the assignee under the trademark PLAY DOH®. In addition, the curable liquid 24 may be an algin, alginate, or sodium alginate, while the non-curable liquid 26 may be a gel-like substance. The gel-like substance may be a transparent inorganic clay colloidal dispersion such as a synthetic smectite clay dispersion in water. The gel may be colorless and contain a preservative such as imidiazolidinyl urea. The gel may comprise between approximately 1.5 percent and 4 percent by weight or synthetic smectite clay and between approximately 0.05 and 0.5 weight percent of imidiazolidinyl urea preservative. A suitable synthetic smectite clay for forming the gel is readily available from Laporte Industries Ltd., Cheshire, England, under Trademark LAPONITE®. Other materials with comparable viscosities, such as but not limited to gelatin, pudding, masorb, oatmeal, gravy, and toothpaste, could be used as the non-curable liquid 26.

It is to be understood that other materials and compounds can be employed as the modeling compound 22 and the curable liquid 24 as well, as long as the modeling compound 22 is adapted to have impressions formed therein for creation of toys 30, and includes chemical characteristics enabling reaction with the curable liquid 24 with which the modeling compound 22 comes into contact.

Figure 2:
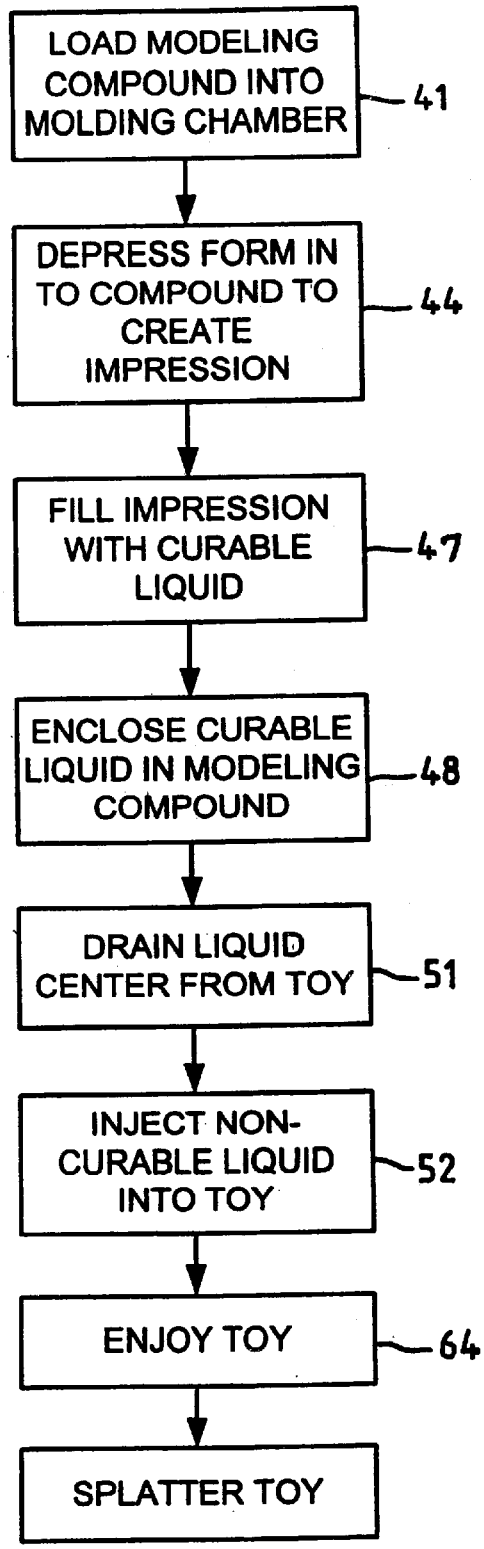
FIG. 2 is a flow chart depicting steps which may be taken in practicing the method according to the teachings of the invention.
Figure 3:
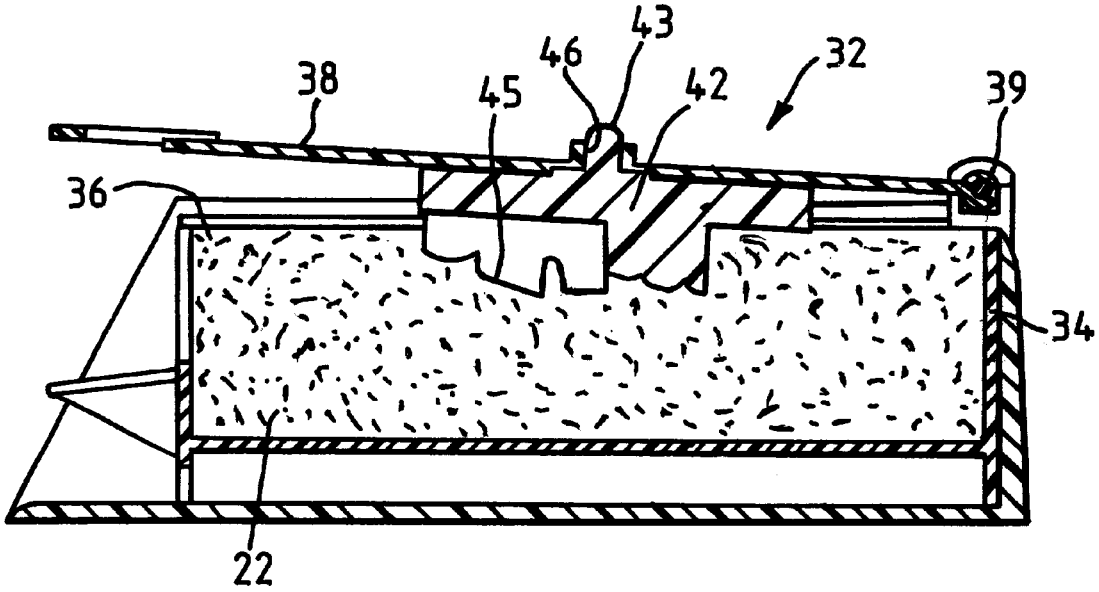
FIG. 3 is a perspective view of an impression being formed within a molding chamber constructed in accordance with the teachings of the invention.

Referring now to FIG. 3, a molding chamber 32 forming part of the workstation 28 of the kit 20 is shown in detail. The molding chamber 32 includes a housing 34 having an open top 36. The open top 36 is closable by a lever arm 38 attached to the housing 34 at a pivot 39. In order to form a mold 40, the modeling compound 22 is loaded into the molding chamber 32. This step is referred to by reference numeral 41 in the flow chart of FIG. 2. A form 42 is then attached to the lever arm, as by a peg 43. The lever arm 38 is then depressed against the form 42 to force the form 42 into the modeling compound 22 as indicated by a step 44. An impression 45 is thereby created in the modeling compound having the shape of the form 42. Frictional interference between the peg 43 and an aperture 46 in the lever arm 38 is sufficient to secure the form 42, but it is to be understood that alternative structures and methods can be employed, including simply placing the form 42 on top of the modeling compound 22 and depressing the lever arm 38. In the depicted embodiment, the form 42 is provided in the shape of an insect, but it is to be understood that the form 42 can be provided in any imaginable shape to create any desired type of toy 30. It is intended that the kit 20 be provided with a plurality of forms 42.

Figure 4:
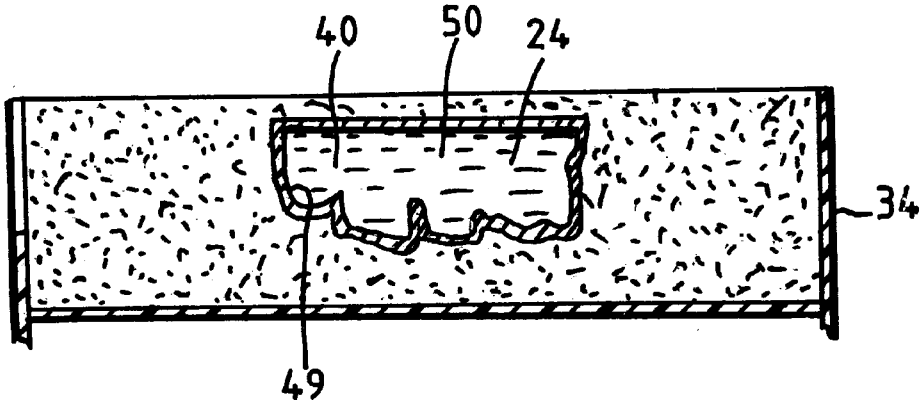
FIG. 4 is a cross-sectional view of a toy formed within modeling compound and including an interior of curable liquid according to the teachings of the invention.

As shown in FIG. 2 by a step 47 in FIG. 2, once the impression 45 is formed in the modeling compound 22, the impression 45 is filled with the curable liquid 24. The liquid 24 within the impression 45 is then covered with additional modeling compound 22 as shown in FIG. 4 and indicated by a step 48 in FIG. 2. The calcium enriched modeling compound 22 reacts with the liquid 24 to create a solid exterior skin 49 surrounding a liquid interior 50. Since liquid interior 50 would also cure if the modeling compound 22 is provided around the toy 30 for a sufficient length of time, it is important to monitor the time that the liquid interior 50 is exposed to the modeling compound 22. It is intended that the modeling compound 22 only remain in contact with the curable liquid 24 for a relatively short period of time, e.g., approximately 3 to 5 minutes, to ensure that the exterior skin 49 is formed, but that the liquid interior 50 is not cured.

Once the exterior skin 49 is formed, the modeling compound 22 can be removed and the remainder of the curable liquid 24 can be drained as depicted by a step 51 in FIG. 2. In a preferred embodiment according to the teachings of the invention, the exterior skin 49 is punctured, and the toy 30 is squeezed to allow the liquid interior 50 to be pushed or squeezed from the skin 49. In an alternative embodiment, the curable liquid 24 could be withdrawn through the use of a syringe pump, or the like.

Figure 5:
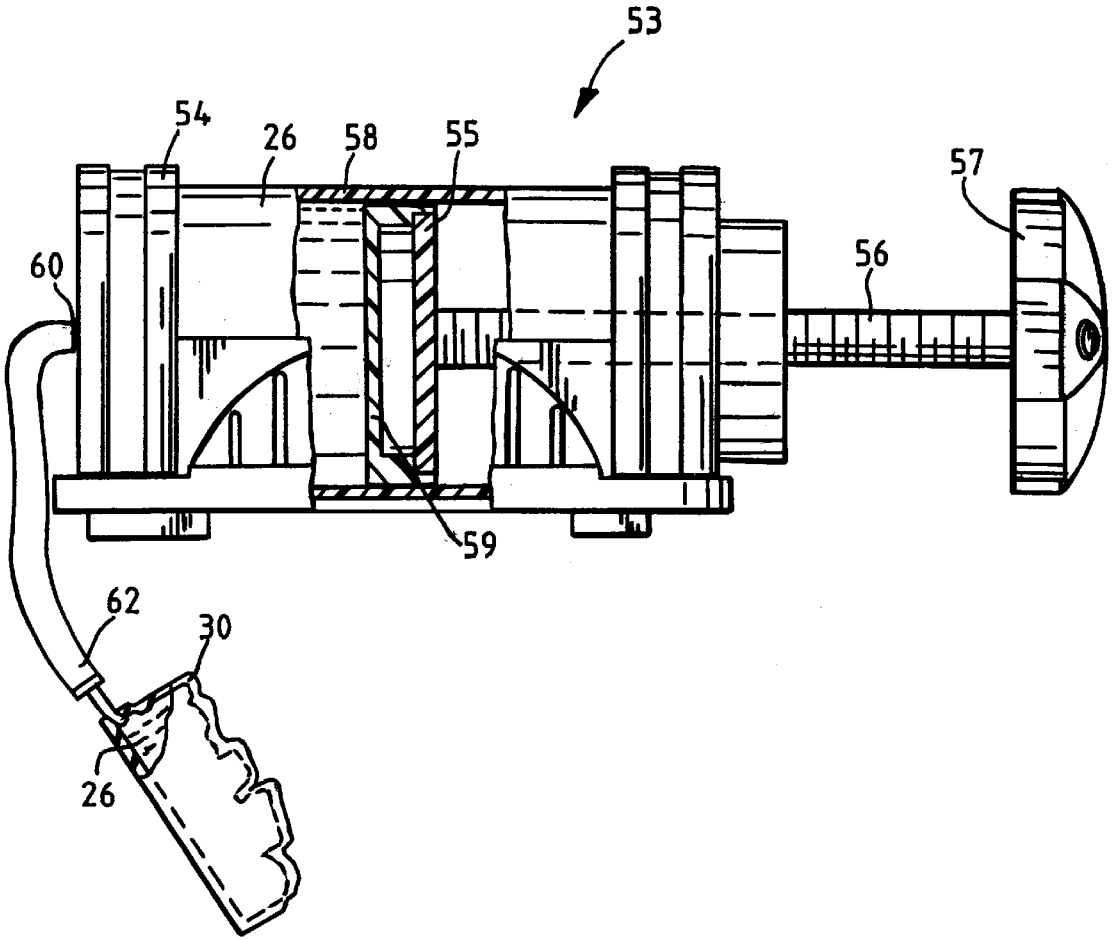
FIG. 5 is a cross-sectional view of an injection mechanism filling a toy according to the teachings of the invention.

After the curable liquid 24 is removed, the non-curable liquid 26 is injected into the toy 30 as indicated by a step 52 in FIG. 2. Referring now to FIG. 5, a preferred embodiment of an injector 53 forming part of the workstation 28 according to the teachings of the invention is depicted. The injector 53 includes a housing 54 adapted to receive a supply of the non-curable liquid 26. A piston 55 attached to a threaded stem 56 is adapted for linear translation through the housing 54. An operable handle 57 is attached to the stem 56 such that rotation of the handle 57 causes rotation of the threaded stem 56 and piston 55, and axial translation of the piston 55 through the housing 54. Since the non-curable liquid 26 is preferably provided in a vial 58 having a movable plate 59, rotation of the handle 57 causes the piston 55 to push through the vial 58 thereby causing the non-curable liquid 26 to be pushed from the vial 58 via a nose 60. A flexible hose 62 extends from the nose 60 and is adapted to inject the non-curable liquid 26 into the toy 30. In an alternative embodiment, the non-curable liquid 26 could be injected into the toy 30 using a conventional syringe, motorized pump, or the like.

Once the toy 30 is completed, it can be enjoyed by the child in multiple ways as shown by a step 64. For example, the exterior skin 49 is preferably brightly colored and the non-curable liquid 26 is preferably gel-like to provide a visual contrast to the child. The liquid interior 50 provides the illusion of a life-like organism or being. Moreover, the workstation 28 preferably includes a destruction mechanism 66 to further enhance use of the toy 30. For example, if the toy 30 is provided in the form of an insect, the non-curable gel-like liquid 26 appears to be the bodily fluid of the insect. Upon crushing or rupturing of the exterior skin 49, the non-curable liquid 26 squirts out and splatters in much the same manner as a real insect.

Figure 6A:
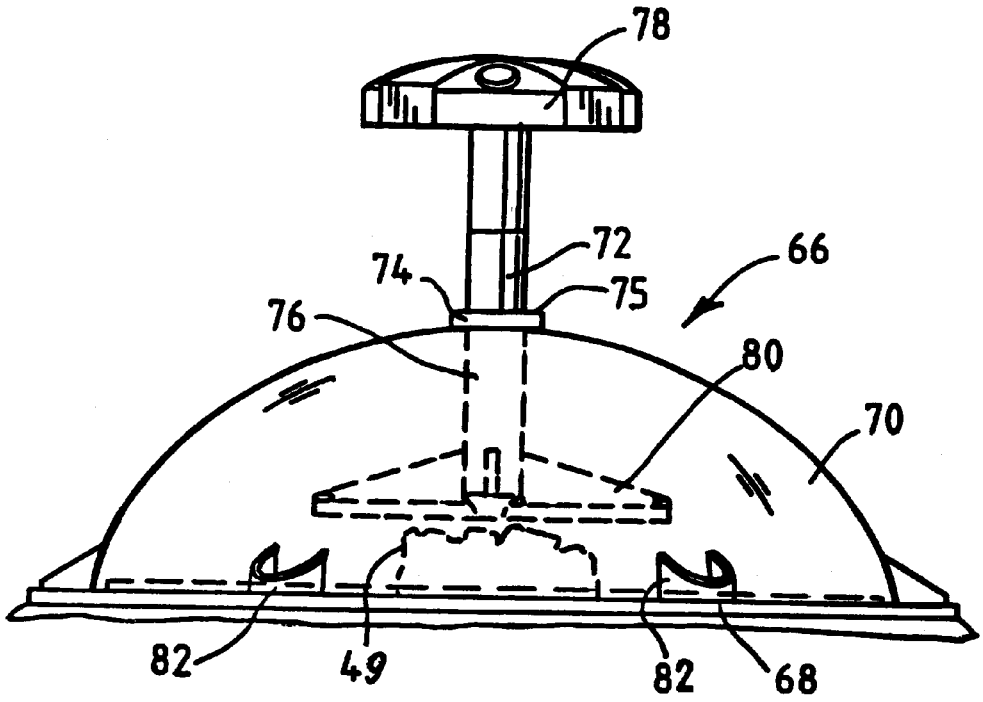
FIG. 6A is a cross-sectional view of a toy destruction mechanism and toy constructed in accordance with the teachings of the invention, with the destruction mechanism being depicted in a first position.
Figure 6B:
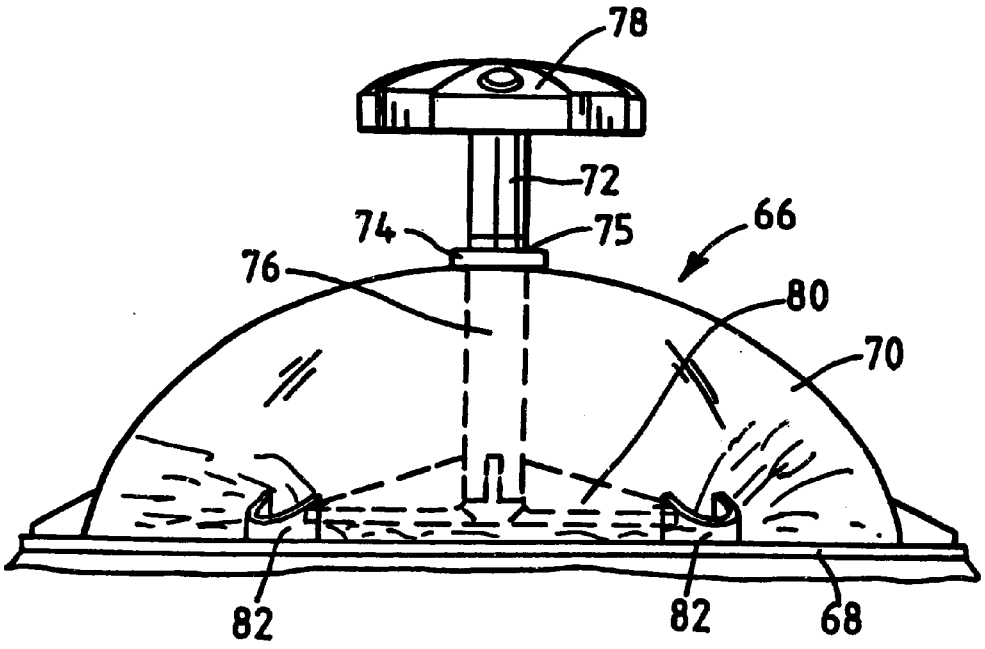
FIG. 6B is a cross-sectional view of a the destruction mechanism of FIG. 6A, but with the destruction mechanism being depicted in a second position.

Referring now to FIGS. 6A and 6B, a preferred embodiment of the destruction mechanism 66 is shown in detail. The destruction mechanism 66 preferably includes a housing base 68, a removable cover 70, and a plunger 72. The cover 70 is preferably hemispherical in shape and transparent to allow optimal viewing of the crushing process. At an apex 74 of the cover 70, an aperture 75 is provided through which the plunger 72 is reciprocatingly mounted. The plunger 72 includes a stem 76, a handle 78 and a crushing plate 80. To facilitate assembly, the handle 78 and crushing plate 80 may each include portions of the stem 76 which are separated for introduction through the aperture 75, and then subsequently reattached. A plurality of retainers 82 may extend from the base 68 to hold the cover 70 in place.

As shown in a comparison between FIGS. 6A and 6B, the plunger 72 is movable between a first or loading position, shown in FIG. 6A, and a second or crushing position shown in FIG. 6B. In the loading position of FIG. 6A, the toy 30 can be placed upon the housing base 68 directly below the plate 80. The child can then manually depress or pound the plunger 72 directly downwardly with sufficient force to cause the plate 80 to engage and crush the toy 30. As shown in FIG. 6B, when the toy 30 is crushed, the exterior skin 49 is ruptured thereby allowing the liquid interior 50 to be splattered outwardly against the cover 70. The cover 70 and housing base 68 can then be washed or wiped down for subsequent use. Both may be coated with a non-stick layer or the like to facilitate clean-up.

From the foregoing, it can be readily appreciated that the teachings of the invention can be employed to create a toy manufacturing and destructing kit resulting in realistic toys being created, enjoyed, and potentially crushed or otherwise destroyed.

What is claimed is:

1. A method of fabricating a toy, comprising:

creating an impression in a supply of modeling compound;

filling the impression with a curable liquid;

enclosing the curable liquid with additional modeling compound;

curing an exterior layer of the curable liquid to create a toy having an exterior skin in a shape corresponding to the impression;

removing the toy from the modeling compound;

removing the curable liquid from an interior of the toy; and filling the interior of the toy with a non-curable liquid.

2. The method of claim 1, wherein the exterior layer is cured through a chemical reaction between the modeling compound and the curable liquid.

3. The method of claim 2, wherein the modeling compound contains calcium and the curable liquid is an algin.

4. The method of claim 1, wherein the non-curable liquid is a gel-like substance.

5. The method of claim 4, wherein the gel-like substance is a synthetic smectite clay.

6. The method of claim 1, wherein the modeling compound is a calcium enriched modeling compound.

7. The method of claim 1, wherein the impression is created by depressing a desired form into the modeling compound.

8. The method of claim 1, wherein the curable liquid is removed by puncturing the exterior skin and squeezing the toy.

9. The method of claim 1, wherein the toy is filled with non-curable liquid using a syringe.

10. The method of claim 1, further including destroying the toy after the toy is filled with the non-curable liquid.

11. The method of claim 10, wherein the toy is destroyed by compressing the toy and rupturing the exterior skin.

12. A toy kit, comprising:

a supply of modeling compound;

at least one form adapted to deform the supply of modeling compound to create an impression having a shape corresponding to a shape of the form;

a supply of curable liquid adapted to be poured into the impression and be cured into a toy having a shape complementary to the form, the toy having a solid exterior skin and a liquid center adapted to be drained; and a supply of non-curable liquid adapted to be injected into the toy after the curable liquid is drained from the toy.

13. The toy kit of claim 12, wherein the modeling compound contains calcium and the curable liquid is an algin.

14. The toy kit of claim 12, wherein the non-curable liquid is a gel-like substance.

15. The toy kit of claim 14, wherein the gel-like substance is a synthetic smectite clay.

16. The toy kit of claim 12, wherein a plurality of forms are provided, at least one of the plurality of forms being in a shape of an insect.

17. The toy kit of claim 12, further including a destruction mechanism adapted to destroy toys once formed.

18. The toy kit of claim 17, wherein the destruction mechanism comprises:

a housing base;

a transparent dome releasably mounted to the housing base;

a plunger reciprocatingly mounted through the transparent dome, the plunger being movable between a crushing position against the housing base to a loading position raised above the housing base.

19. A toy crushing device, comprising:

a housing base;

a transparent cover removably mounted to the housing base;

a plunger reciprocatingly mounted through the cover, the plunger including a handle and a plate, the plate being movable between a crushing position proximate the housing base, and a loading position raised away from the housing base; and a molding chamber, the molding chamber including a reservoir for receipt of modeling compound and a pivotable lever adapted to push a form into the modeling compound.

20. The toy crushing device of claim 19, wherein the cover is substantially hemispherical.

21. A toy kit, comprising:

a supply of calcium-enriched modeling compound;

a plurality of molds adapted to deform the supply of modeling compound to create an impression;

a supply of curable liquid adapted to be poured into the impression and be cured into a toy having a shape complementary to the impression, the toy having a solid exterior skin and a liquid center adapted to be drained;

a supply of non-curable liquid adapted to be injected into the toy after the curable liquid is removed; and a crushing device adapted to compress the toy sufficiently to rupture the exterior skin of the toy and splatter the non-curable liquid outwardly.

22. The toy kit of claim 21, further including an injector, the injector including a housing adapted to receive a vial of the non-curable liquid, a linearly translatable piston adapted to reciprocate through the housing, and a flexible tube adapted to penetrate the toy and place the vial in communication with an interior of the toy.

23. The toy kit of claim 22, wherein the piston is threadably attached to the housing, rotation of the piston in a first direction causing linear translation of the piston through the housing.

24. The toy kit of claim 21, further including a molding chamber, the molding chamber adapted to receive the supply of modeling compound, the chamber further including an actuation lever adapted to push one of the plurality of molds into the modeling compound.

* * * * *

UNITED STATES PATENT AND TRADEMARK OFFICE

CERTIFICATE OF CORRECTION

PATENT NO. : 6,589,096 B1
DATED : July 8, 2003
INVENTOR(S) : Doane, Jr. et al.

It is certified that error appears in the above-identified patent and that said Letters Patent is hereby corrected as shown below:

Column 6,
Line 32, please replace "substantially hemispherical" with -- hemispherical --.

Signed and Sealed this

Seventeenth Day of February, 2004

JON W. DUDAS
*Acting Director of the United States Patent and Trademark Office*